United States Patent [19]

Hay

[11] 4,121,499

[45] Oct. 24, 1978

[54] SWITCHING MECHANISM

[75] Inventor: Andrew George Hay, Hamilton, Scotland

[73] Assignee: The Secretary of State for Industry in Her Britannic Majesty's Government of the United Kingdom of Great Britain and Northern Ireland, London, England

[21] Appl. No.: 760,953

[22] Filed: Jan. 21, 1977

[30] Foreign Application Priority Data

Jan. 29, 1976 [GB] United Kingdom ..... 3555/76

[51] Int. Cl.[2] ..... F01L 25/06; F01B 7/18

[52] U.S. Cl. ..... 91/282; 91/293; 91/300; 91/321; 92/108

[58] Field of Search ..... 91/300, 282, 283, 293, 91/321, 294

[56] References Cited

U.S. PATENT DOCUMENTS

| | | | |
|---|---|---|---|
| 1,306,301 | 6/1919 | Chadwick | 91/300 |
| 1,594,217 | 7/1926 | Smith, Jr. | 91/283 |
| 2,698,517 | 1/1955 | Witt | 91/283 |
| 2,914,037 | 11/1959 | Johnston | 91/283 |
| 3,094,842 | 6/1963 | Johnston | 91/300 |
| 3,552,269 | 1/1971 | Arndt | 91/300 |
| 3,887,019 | 6/1975 | Reynolds et al. | 91/300 |

*Primary Examiner*—Paul E. Maslousky

*Attorney, Agent, or Firm*—Cushman, Darby & Cushman

[57] ABSTRACT

The invention provides a hydraulically-driven reciprocatory tool comprising a piston with a shoulder reciprocable in a cylinder, and a shuttle valve for controlling supply of fluid to a first face of the piston, the fluid producing a force on the first face which is alternately greater than and less than a constant bias force applied to a second face of the piston, wherein the position of the shuttle valve is determined by the pressure of fluid in a fluid connection between the shuttle valve and first and second ports in the wall of the cylinder, the fluid connection including a first non-return valve for preventing flow of fluid from one of the ports to the shuttle valve and a second non-return valve for preventing flow of fluid from the shuttle valve to the other of the ports. Preferably, each non-return valve has associated with it a variable throttle in the fluid connection and further means are provided for controllable flow of fluid along a branch of the fluid connection.

9 Claims, 8 Drawing Figures

SWITCHING MECHANISM

This invention relates to devices in which a piston within a cylinder can be caused to execute reciprocatory motion by an alternating differential pressure acting on the opposed faces of the piston.

In many applications of devices employing reciprocating pistons, for example hydraulic hammers, it is desirable to have as long a piston stroke as possible within the limit determined by the overall length of the device. In known pressure sensed reciprocatory devices in which the position of the piston controls the operation of valve gear which in turn controls flow of the fluid to, and hence acceleration of, the piston, the length of the cylinder is extended in length beyond that to a simple ram by the presence of pressure sensing grooves in the cylinder casing to allow communication of pressure within the cylinder, at appropriate instants in the cycle, to the valve gear. Such known devices either have cylinders which are undesirably long or have a relatively short piston stroke, and this necessittes a high reaction force for a given impact force.

This invention seeks to provide a reciprocatory tool which provides a piston which can reciprocate with a stroke length which is longer for a given cylinder length than the known pressure sensed reciprocatory devices. Preferred embodiments of tool according to the present invention seek to provide a stroke length of the piston which can be varied.

The present invention provides a reciprocatory device comprising (a) first and second members able to reciprocate relative to one another along an axis, the first member having a shoulder in fluid-tight contact with the second member, and the second member defining first and second ports spaced from one another, (b) defined by the first and second members a first fluid enclosure on one side of the shoulder and a second fluid enclosure on the other side of the shoulder, the arrangement of ports and shoulder being such that each of the ports can communicate, at one relative position of the first and second members, with the first fluid enclosure only and, at a different relative position of the first and second members, with the second fluid enclosure only, and (c) a signal line connectable to a valve, actuatable by changes in fluid pressure in the signal line, to provide forces which move the first and second members relative to one another, the signal line being connected to the first port through a first fluid passage which includes a non-return valve arranged to prevent flow of fluid along the passage to the first port, and being connected to the second port through a second fluid passage which includes a non-return valve arranged to prevent flow of fluid along the passage away from the second port.

In use of the apparatus of the invention, the first fluid enclosure contains fluid at a different hydrostatic pressure from that present in the second fluid enclosure.

Preferably, the first member is a piston and the second member is a body defining a cylinder in which the piston can reciprocate. In a preferred embodiment, the piston has a blind bore into which a part of the body can project. In use of the preferred embodiment, the piston is biassed to move in one direction in the cylinder by the action of relatively high fluid pressure in the first fluid enclosure, and relatively low fluid pressure is present in the second fluid enclosure. Forces are applied to the end of the blind bore by the valve, which forces are alternately greater and less than the bias force of the relatively high pressure in the first fluid enclosure on the shoulder.

During use of the preferred emboidment, the pressure within the cylinder adjacent to the cylinder wall is constantly high on one side of the shoulder and low on the other. The pressurised fluid from the valve, which provides the force for driving the piston against the biassed pressure on one side of the shoulder, is necessarily isolated from the cylinder wall. The force on the end surface of the blind bore can be applied by feeding fluid at high pressure into a chamber sealed by a seal between the cylindrical surface of the bore and a snout on the body which projects into the bore. Alternativey, force can be applied by a piston rod urged onto the end surface by fluid pressure. So that the piston can be driven against the bias force by fluid at the same pressure as the bias fluid pressure in the first fluid enclosure on the side of the shoulder, the area of the end wall of the blind bore (or of the piston rod as appropriate) acted on by the fluid pressure is arranged to be considerably greater than the area of the side of the shoulder.

The effective function of the two ports is to detect in which part of the cylinder the shoulder is located at any given instant, and they are preferably located close to opposite ends of the cylinder. While it is convenient to use the relatively high hydrostatic pressure of fluid present in the first fluid enclosure to bias the piston to move in one direction, it is envisaged that other means of so biasing the piston could be used. For example, a compression spring located between the body and an annular surface of the piston could be used.

By way of example, embodiments of the invention will now be described with reference to the accompanying drawings, in which:

FIG. 1 (*a*) to (*d*) is a 4-part schematic diagram of a hydraulic piston in a cylinder (cut away), each part of which illustrates respectively the pattern of fluid pressure at a particular instant in the cyclic motion of the piston;

Figure 1A:
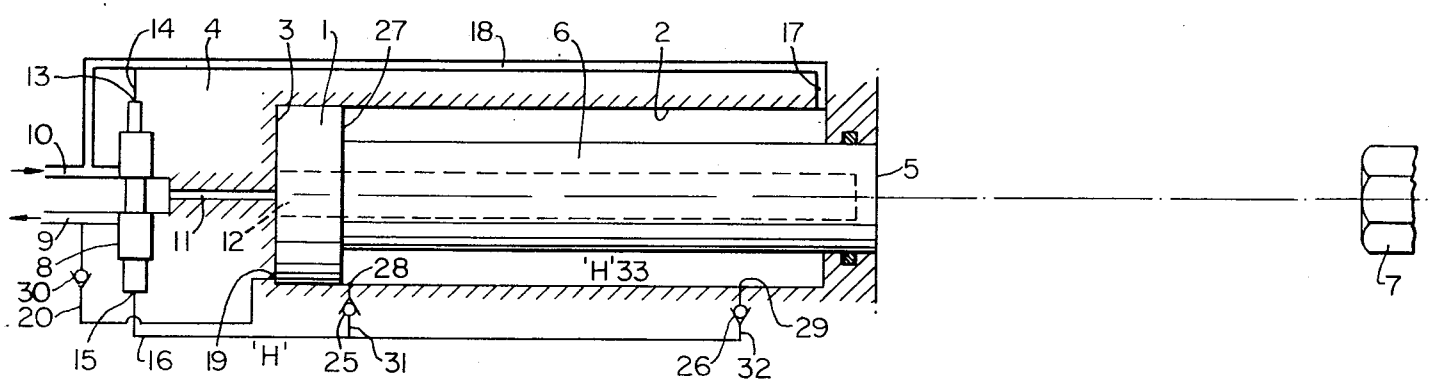
Figure 1B:
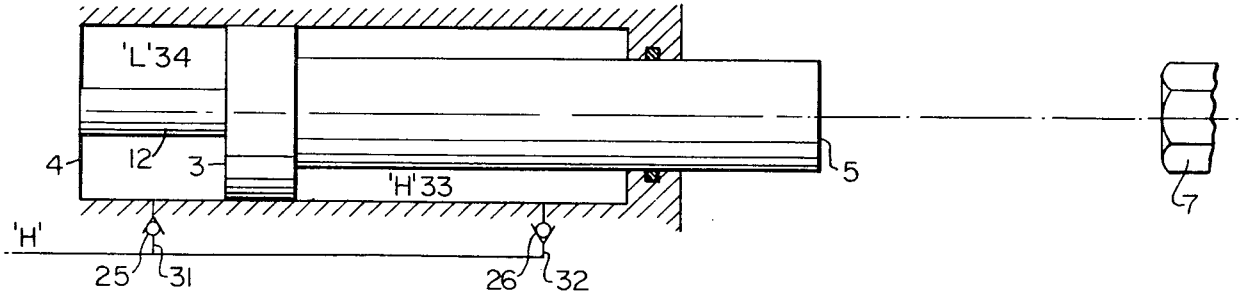

FIG. 1 (a) to (d) shows a reciprocatory device comprising a first member constituted by a driving piston 6 and a second member constituted by a body 4 defining a cylinder 2. The driving piston 6 is reciprocable within the cylinder 2 between a retracted position, shown in FIG. 1 (*a*) in which a rear face 3 of the piston is close to a rear end 4 of the cylinder 2, and a forward position, shown FIG. 1 (*c*) at which a forward end 5 of the piston 6 strikes the rear end of a tool bit 7. FIG. 1 (*b*) and (*d*) show the piston 6 at intermediate positions between the fully retracted and the fully forward positions. Piston 6 has a shoulder 1 of enlarged diameter which is in the fluid-tight contact with the cylindrical surface of the cylinder. This shoulder 1 of the piston 6 may be termed the "Crown" or "head" of the piston.

A shuttle valve 8 is arranged to connect either a low pressure fluid supply line 9 or a high pressure fluid supply line 10 to a line 11 and hence to a tube or snout 12 extending forward parallel to the axis of the cylinder 2 from the rear end of the cylinder. The shuttle valve 8 is biassed in such a way as to connect the low pressure fluid supply line 9 to line 11 by subjecting it to the high pressure in fluid supply line 10 fed through a duct 14 to a signal port 13 communicating with a small shuttle face. The shuttle valve 8 is controlled and actuated by the presence or absence of high pressure H in a signal line 16 extending from a signal port 15, communicating with a large shuttle face. The signal line 16 is connected to a first fluid passage 31 ending in a port 28 and including a non-return valve 25. It is also connected to a second fluid passage 32 ending in a port 29 and including a non-return valve 26. The non-return valves 25 and 26 permit, respectively, flow of fluid out of the cylinder through the port 28 which is located in the cylinder wall close to its rear end, and flow into the cylinder 2 through the port 29 which is located near its forward end.

The cylinder 2 is provided with a port 17 at its forward end permanently connected to the high pressure fluid supply line 10 through a duct 18 so that a first fluid enclosure 33 in the interior of the cylinder and forward of the shoulder 1 can be maintained at a high pressure H. A port 19 at the rear end of the cylinder 2 is connected to the low pressure of the fluid supply line 9 through a duct 20 including a non-return valve 30 which permits flow of the fluid from the cylinder to the line 9 but not in the other direction, and which hence maintains the interior of the cylinder in a second fluid enclosure 34, rearward of the piston 6 and outside the tube 12 at low pressure L.

Figure 2:
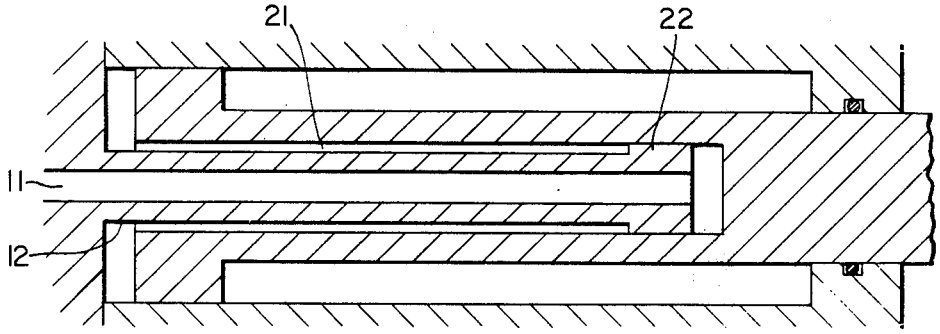
FIG. 2 is an axial section illustrating one way of supplying pressurised fluid to the end surface of the blind bore of the piston illustrated in FIG. 1 thereby to apply force to the piston.
Figure 3:
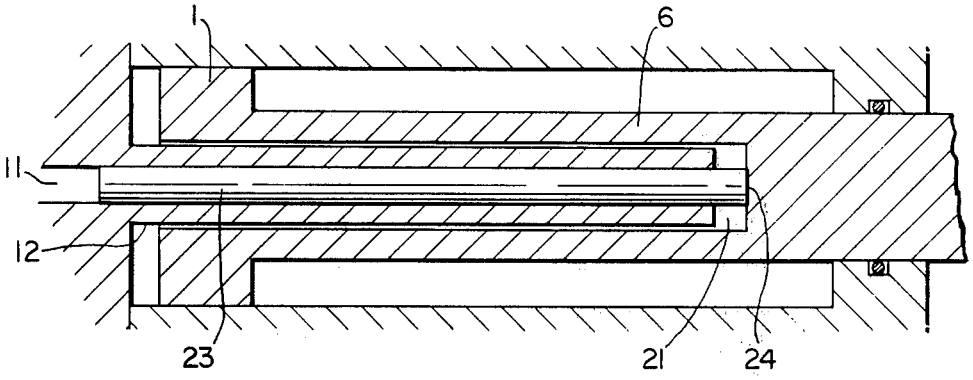
FIG. 3 is an axial section illustrating an alternative method by which force is transmitted from the hydraulic fluid to the end surface of the blind bore in the piston.

It is necessary to isolate fluid flow between the shuttle valve 8 and the tube 12, which fluid drives the piston forward, from that part of the volume within the cylinder which is outside the tube 12. FIGS. 2 and 3 respectively illustrate two methods by which this may be done. In the embodiment illustrated in FIG. 2, the tube or snout 12 extends into a blind bore 21 in the piston 6, the end portion 22 of the tube 12 having a seal with the cylindrical surface of the bore 21. In the embodiment illustrated in FIG. 3, the bore of the tube 12 contains a rod piston 23 slideable within the bore of the tube and in sealing contact with it, and the rod piston 23 can be urged against the end surface 24 of the blind bore 21 by the application to it of fluid pressure The effective area of the driven rear face of the piston 6 is, in FIG. 2, the area of the end surface 24 of the bore 21. In FIG. 3, it is the cross sectional area of the rod piston 23 acted on by fluid. In both cases this area is arranged to be approximately twice the effective area of an annular forward face 27 of the shoulder 1 between the piston 6 and the cylinder wall, so that the piston 6 anc be driven forwards or backwards depending on whether the bore in the tube 12 is in communication with the high pressure fulid supply line 10 or the low pressure fluid supply line 9. In this respect in particular FIGS. 2 and 3 are not to scale.

Figure 1C:
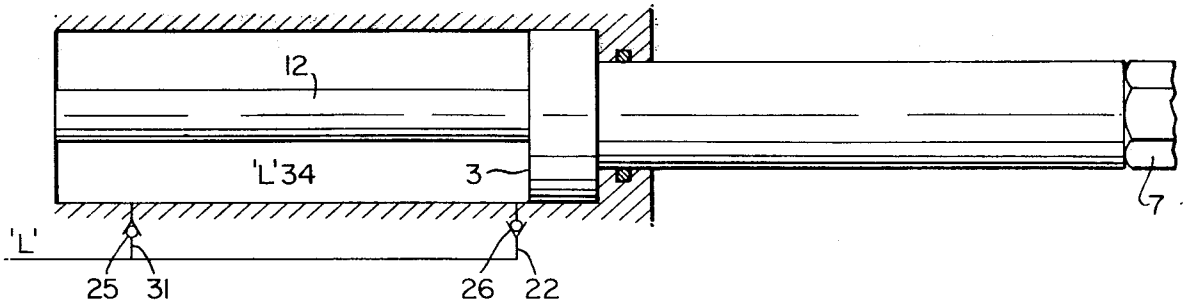
Figure 1D:
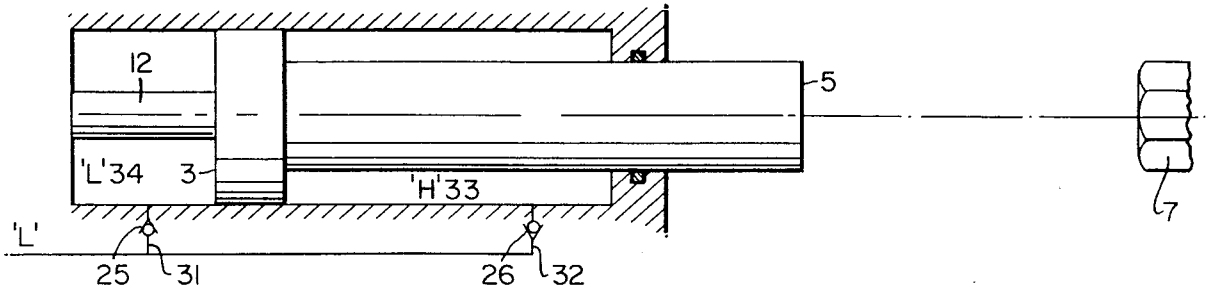

The apparatus shown in FIG. 1, which may include the embodiment of FIG. 2 or of FIG. 3, operates as follows. At the configuration illustrated in FIG. 1*a* in which the piston 6 is in the retracted position, fluid at high pressure communicates with the signal line 16 through duct 18, port 17, first fluid enclosure 33, port 18 and non-return valve 25, so that the shuttle valve 8 is in a position connecting the high pressure fluid supply line 10 to the tube 12. Fluid at high pressure H present in the first fluid enclosure 33 acts on the annular forward face 27 of the shoulder 1 at all positions of piston 6. The piston 6 wll thus be accelerated forward as the pressure on the effective area of its rear face exerts a greater force than the same, high pressure acting on its effective smaller front face 27. When the piston 6 moves forward to cover and pass the port 28 (FIG. 1*b*), direct communication between the high pressure supply and the signal line 16 is broken but, since fluid can only leak very slowly from the supply line 16, the shuttle valve 8 cannot switch until the shoulder 1 passes the port 29 (FIG. 1*c*). After this, fluid flows from the signal line 16 into the second fluid enclosure 34 behind the shoulder 1, which enclosure 34 is in constant communication with the low pressure fluid supply line 9 through duct 20. On reduction to low pressure of the pressure in signal line 16 and hence at signal port 15, the shuttle valve 8 switches under the action of high pressure fluid in its narrow bore signal port 13, so that the fluid drains from tube 12 via the line 11 to the low pressure fluid supply line 9, initiating a retraction of the piston 6 under the action of the high pressure fluid acting via line 18 and port 17 on its annular forward face 27.

During retraction of the piston (FIG. 1*d*), when the piston 6 is between ports 28 and 29, high pressure fluid cannot enter the signal line 16 through the non-return valve 26, so that the shuttle valve 8 does not switch until the shoulder 1 passes port 28. At this instant (FIG. 1*a*), high pressure fluid H enters the signal line 16 from the first fluid enclosure 33 and passes through non-return valve 25 to switch the shuttle valve 8 and hence initiate another advance of the piston.

It will be seen that reciprocation of the piston 6 will continue until the supply of high pressure hydraulic fluid to it is discontinued, and that the length of cylinder additional to that of the stroke of the piston is no more than that occupied by the thickness of the shoulder 1.

Figure 4:
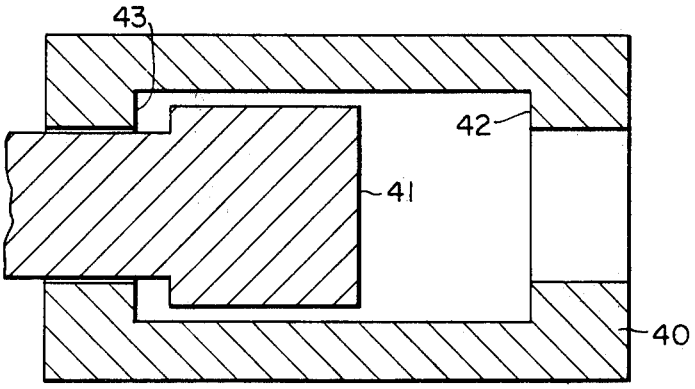
FIG. 4 is an axial section of an anvil for use with the apparatus shown in FIG. 2 or FIG. 3.

FIG. 4 shows an anvil 40 which encloses a head 41 of a hammer piston. A hammer piston can be the piston 6 of the apparatus shown in the preceding Figures. As the hammer piston is caused to reciprocate then opposed faces of its head 41 strike interior surfaces 42 and 43 of anvil 40 alternately. The scale of FIG. 4 is not the same as that of FIGS. 1 to 3.

Figure 5:
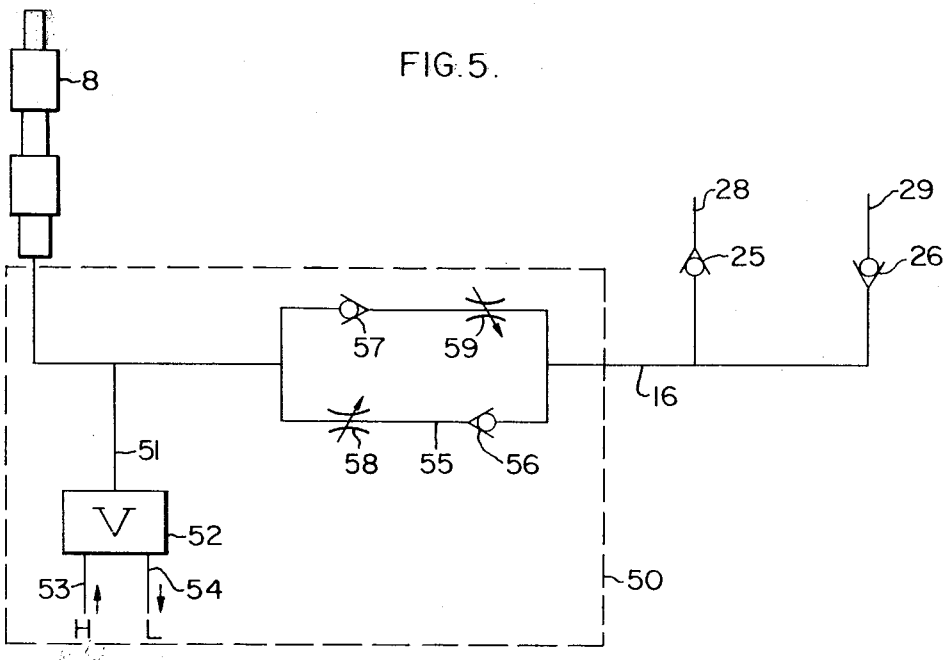
FIG. 5 is a schematic diagram of part of a hydraulic circuit which can be included in the apparatus shown in FIG. 1.

FIG. 5 shows a part of a hydraulic circuit, denoted generally by reference 50, which can be included in signal line 16 of FIG. 1. It comprises a branch 51 of the signal line 16, the branch leading to a modifier valve 52 which has high and low pressure hydraulic fluid lines 53 and 54 respectively. The modifier valve 52 is capable of admitting a controlled flow of hydraulic fluid into the branch 51 from high pressure line 53 or of allowing a controlled flow of fluid out of branch 51 through low pressure line 54.

Signal line 16 has a loop 55 which includes first and second non-return valves 56 and 57 respectively. First and second variable throttles 58 and 59 respectively are provided adjacent the non-return valves 56 and 57. The arrangement is such that the second variable throttle 59 throttles only flow from the port 28 to the valve 8, and the first variable throttle 58 throttles only flow from the valve 8 to the second port 29. The same effect can be achieved by locating the throttle 59 adjacent to the non-return valve 25 and throttle 58 adjacent the non-return valve 26.

The modifier valve 52 functions as follows. As shown above, the stroke of the piston 6 is normally such as to carry its shoulder 1 alternately beyond ports 28 and 29. This is because the shoulder must travel the full length of the cylinder 2 before the fluid pressure in the signal line 16 can change enough to switch the shuttle valve 8. However, where the modifier valve 52 allows fluid to flow either into or out of the signal line 16 along the branch 51 then the pressure in the signal line can change sufficiently to switch the shuttle valve 8 before the shoulder 1 has travelled the full length of the cylinder 2. Thus the shoulder 1 can oscillate between an end of the cylinder 2 and a point between the ends of the cylinder, which point can be varied by varying the flow through the modifier valve.

The variable throttles 58 and 59 function similarly to one another when shoulder 1 moves to a position which allows high pressure fluid to enter the signal line 16 then if the variable throttle 59 restricts the flow of fluid along the line 16 there is a delay before the pressure of the shuttle valve 8 builds up sufficiently to switch the valve. The piston 6 can thus be made to "wait" at one end of its stroke for a period fixed by the degree of throttling of the variable throttle 59. The operation of the variable throttle 58 is similar in that it delays the flow of fluid away from the shuttle valve 8 and through the port 29 so causing the piston 6 to "wait" at the other end of its stroke. The modifier valve 52 and the variable throttles 58 and 59 can be used in combination to provide a wide variation of piston movements. The shuttle valve 8 can be replaced by a non-inverting valve substantially as described and shown in West German Offenlegungs Schrift No. 26 31 301.

What is claimed is:

1. A reciprocatory device comprising:

a piston and a body defining a cylinder within which the piston can reciprocate along an axis, the piston having a shoulder in fluid-tight contact with the cylinder, and the cylinder defining first and second ports spaced from one another in the axial direction;

a first fluid enclosure capable of being maintained at a relatively high pressure on one side of the shoulder and a second fluid enclosure capable of being maintained at a relatively low pressure on the other side of the shoulder, each enclosure being defined by the piston and cylinder, the arrangement of ports and shoulder being such that each of the ports can communicate, at one relative position of the piston and cylinder, with the first fluid enclosure only, and at a different relative position of the piston and cylinder, with the second fluid enclosure only;

a signal line in fluid communication with the first port through a first fluid passage which includes a non-return valve arranged to prevent flow of fluid along the passage to the first port, and being in fluid communication with the second port through a second fluid passage which includes a non-return valve arranged to prevent flow of fluid along the passage away from the second port; and a main control valve having a supply inlet for connection to a high pressure fluid source and a supply outlet for draining fluid at low pressure, and a drive connection isolated in fluid tight manner from the first and second enclosures, the said main control valve having a signal input to which the signal line is connected and being actuable by changes in fluid pressure in the signal line to connect alternately the supply inlet and the supply outlet to the drive connection;

the piston having a blind bore into which a part of the body projects, the said projecting part of the body having a duct through which the force generated by the presence of high pressure fluid in the drive connection can be transmitted to act on the end of the blind bore.

2. A reciprocatory device as claimed in claim 1, wherein the exterior of the projecting part of the body forms a sliding seal with the cylindrical surface of the blind bore, whereby there is formed a third fluid-tight enclosure between the body and the end surface of the blind bore, said third enclosure communicating with the drive connection through the duct in the projecting part.

3. A reciprocatory device as claimed in claim 1 including a first variable throttle located in the fluid connection between the first port and the end of the signal line to be connected to the valve.

4. A reciprocatory device as claimed in claim 3 wherein the first variable throttle is located in a position such that it throttles only fluid flow from the first port towards the valve.

5. A reciprocatory device as claimed in claim 4 including a second variable throttle located in the fluid connection between the second port and the end of the signal line to be connected to the valve.

6. A reciprocatory device as claimed in claim 5 wherein the second variable throttle is located in a position such that it throttles only fluid flow towards the second port and away from the valve.

7. A reciprocatory device as claimed in claim 1 wherein the signal line has a branch to a modifier valve which can permit a controlled flow of fluid out of the signal line along the branch.

8. A reciprocatory device as claimed in claim 7 wherein the modifier valve can receive a supply of fluid at high pressure and can permit a controlled flow of fluid along the branch and into the signal line.

9. A reciprocatory device comprising:

a. a piston and a body able to reciprocate relative to one another, the piston having a shoulder in fluid-tight contact with a cylinder in the body, and the body defining first and second ports spaced from one another by a distance greater than the width of the shoulder;

b. within the cylinder, first and second fluid enclosures separated by the shoulder, the ports and shoulder being arranged such that each of the ports can communicate, at different relative positions of the piston and body, with the first fluid enclosure only and with the seond fluid enclosure only;

c. means to maintain the first and second fluid enclosures full of fluids at differing pressures;

d. a shuttle valve actuatable by changes in fluid pressure at a signal port to provide forces to move the piston relative to the body;

e. a first fluid passage between the signal port and the first port, the fluid passage including a non-return valve arranged to prevent flow of fluid along the passage to the first port;

f. a second fluid passage between the signal port and the second port, the fluid passage including a non-return valve arranged to prevent flow of fluid along the passage away from the second port;

g. at least one variable throttle in a fluid connection between the first and second ports and the signal port of the shuttle valve, and h. a modifier valve communicating with the signal port, which modifier valve can permit a controlled flow of fluid away from the signal port and can receive a supply of fluid at high pressure and permit a controlled flow of such fluid to the signal port of the shuttle valve.

* * * * *